US010294603B2

(12) United States Patent
Brammer, Jr.

(10) Patent No.: US 10,294,603 B2
(45) Date of Patent: May 21, 2019

(54) CLOTHES DRYER HAVING CANTILEVERED, PIVOTING DRYER ARMS

(71) Applicant: Robert Brammer, Jr., Williamsburg, MI (US)

(72) Inventor: Robert Brammer, Jr., Williamsburg, MI (US)

(73) Assignee: STROMBERG CARLSON PRODUCTS, INC., Traverse City, MI (US)

( * ) Notice: Subject to any disclaimer, the term of this patent is extended or adjusted under 35 U.S.C. 154(b) by 453 days.

(21) Appl. No.: 15/045,871

(22) Filed: Feb. 17, 2016

(65) Prior Publication Data

US 2016/0244906 A1 Aug. 25, 2016

Related U.S. Application Data

(60) Provisional application No. 62/118,026, filed on Feb. 19, 2015.

(51) Int. Cl.
*D06F 57/04* (2006.01)

(52) U.S. Cl.
CPC ..... *D06F 57/04* (2013.01)

(58) Field of Classification Search
CPC ..... D06F 57/04; D06F 57/02
USPC ..... 248/210, 205.1; 211/96, 168
See application file for complete search history.

(56) References Cited

U.S. PATENT DOCUMENTS 31,868 A * 4/1861 Buss ..... A47F 5/02 211/163
115,866 A * 6/1871 Johnson ..... D06F 57/04 211/171
144,951 A * 11/1873 Burch et al. ..... A47G 25/0685 211/96
258,767 A * 5/1882 Kennard ..... A47F 5/02 211/168
284,286 A * 9/1883 Downing ..... D06F 57/04 211/171
338,923 A * 3/1886 Carr ..... D06F 57/04 211/171
429,022 A * 5/1890 Etzel ..... A47G 25/0685 211/96
521,368 A * 6/1894 Gildersleeve ..... D06F 57/04 211/100

(Continued)

FOREIGN PATENT DOCUMENTS

GB 2183465 * 6/1987 ..... D06F 57/04

*Primary Examiner* — Michael Safavi
(74) *Attorney, Agent, or Firm* — Flynn Thiel, P.C.

(57) ABSTRACT

A clothes dryer including a dryer body and at least three dryer arms pivotally connected to the dryer body about pivot points. The dryer arms can be folded into a stored position and moved to a deployed position wherein at least two of the dryer arms are spread out to allow clothes to be placed thereon or connected thereto for drying. Each of the dryer arms are able to be received in at least two channels such that each of the dryer arms can be positioned in a plurality of fixed deployed positions. The dryer body can also include a vertical slot for connecting the dryer body to a first support and a horizontal slot for connecting the dryer body to a second support. The dryer arms can have a generally planar profile with at least three pivot points thereof being positioned along a line.

16 Claims, 5 Drawing Sheets

(56) References Cited

U.S. PATENT DOCUMENTS 655,002 A * 7/1900 Orcutt ..... A47G 25/0685 211/104
860,808 A * 7/1907 Keegan ..... D06F 57/04 211/171
882,960 A * 3/1908 Peterson ..... D06F 57/04 211/115
928,292 A * 7/1909 Walsh ..... A47G 25/0685 211/169
931,917 A * 8/1909 Davids ..... D06F 57/04 211/171
993,039 A * 5/1911 Deacon ..... D06F 57/04 211/111
1,087,450 A * 2/1914 Knox ..... A47K 10/04 211/106
1,153,677 A * 9/1915 Deragon ..... A47G 25/0685 211/106
1,366,526 A * 1/1921 Deragon ..... D06F 57/12 211/106
1,561,369 A 11/1925 Stevenson
1,697,866 A * 1/1929 Hansen ..... A47F 5/04 211/163
1,713,704 A * 5/1929 Herman ..... A47F 5/0884 211/119
1,763,318 A * 6/1930 O'Brien ..... A47F 7/10 211/106
1,839,607 A * 1/1932 Slauson ..... D06F 57/08 211/168
1,899,942 A * 3/1933 Claflin, Jr. ..... A47G 25/0685 211/48
1,933,981 A * 11/1933 Householder ..... A47G 25/0685 211/96
1,936,813 A * 11/1933 West ..... A47G 25/0657 211/89.01
2,165,654 A * 7/1939 Rosenthal ..... A47J 47/16 211/41.11
2,282,836 A * 5/1942 Vanderveld ..... A47B 61/003 211/168
2,431,976 A 12/1947 Ajax
2,465,859 A * 3/1949 Fidler ..... A47G 25/0685 211/89.01
2,473,029 A * 6/1949 Kovacs ..... A47G 25/746 211/106
2,647,643 A * 8/1953 Cruikshank ..... A47G 25/08 211/100
2,805,779 A * 9/1957 Caverley ..... A47J 47/16 211/104
2,818,181 A * 12/1957 Crockett, Jr. ..... A47G 25/746 211/104
2,985,314 A * 5/1961 Colombo ..... A47F 7/10 211/168
3,374,899 A * 3/1968 Bator ..... A47K 10/04 211/123
3,389,944 A * 6/1968 Humphrey ..... A47B 17/036 211/168
3,675,785 A * 7/1972 Martin ..... D06F 53/04 211/119.1
3,935,949 A * 2/1976 Cohen ..... A47F 5/01 211/168
4,033,462 A * 7/1977 De Fabritis ..... A47F 5/0876 211/162
4,039,083 A * 8/1977 Leifheit ..... A47G 25/746 211/168
4,127,195 A * 11/1978 Portnoy ..... A47K 10/04 211/100
5,452,809 A * 9/1995 Capel ..... A47F 7/163 211/168
8,141,721 B2 * 3/2012 Harris-Bowman ..... A47F 7/03 206/6.1
2002/0096482 A1 * 7/2002 Smith ..... A47F 5/05 211/96
2006/0175275 A1 * 8/2006 Israel ..... B68B 9/00 211/169

* cited by examiner

CLOTHES DRYER HAVING CANTILEVERED, PIVOTING DRYER ARMS

CROSS REFERENCE TO RELATED APPLICATION

This claims the benefit of U.S. Provisional Application Ser. No. 62/118 026, filed Feb. 19, 2015, which is incorporated herein by reference in its entirety.

FIELD OF THE INVENTION

This invention relates to recreational vehicles, and more particularly to a clothes dryer used with a recreational vehicle or the like.

BACKGROUND OF THE INVENTION

When traveling, it is sometimes difficult to find an easy way to dry wet clothes. A new and easy manner of drying wet clothes is therefore desired.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

The specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

DETAILED DESCRIPTION

Figure 3:
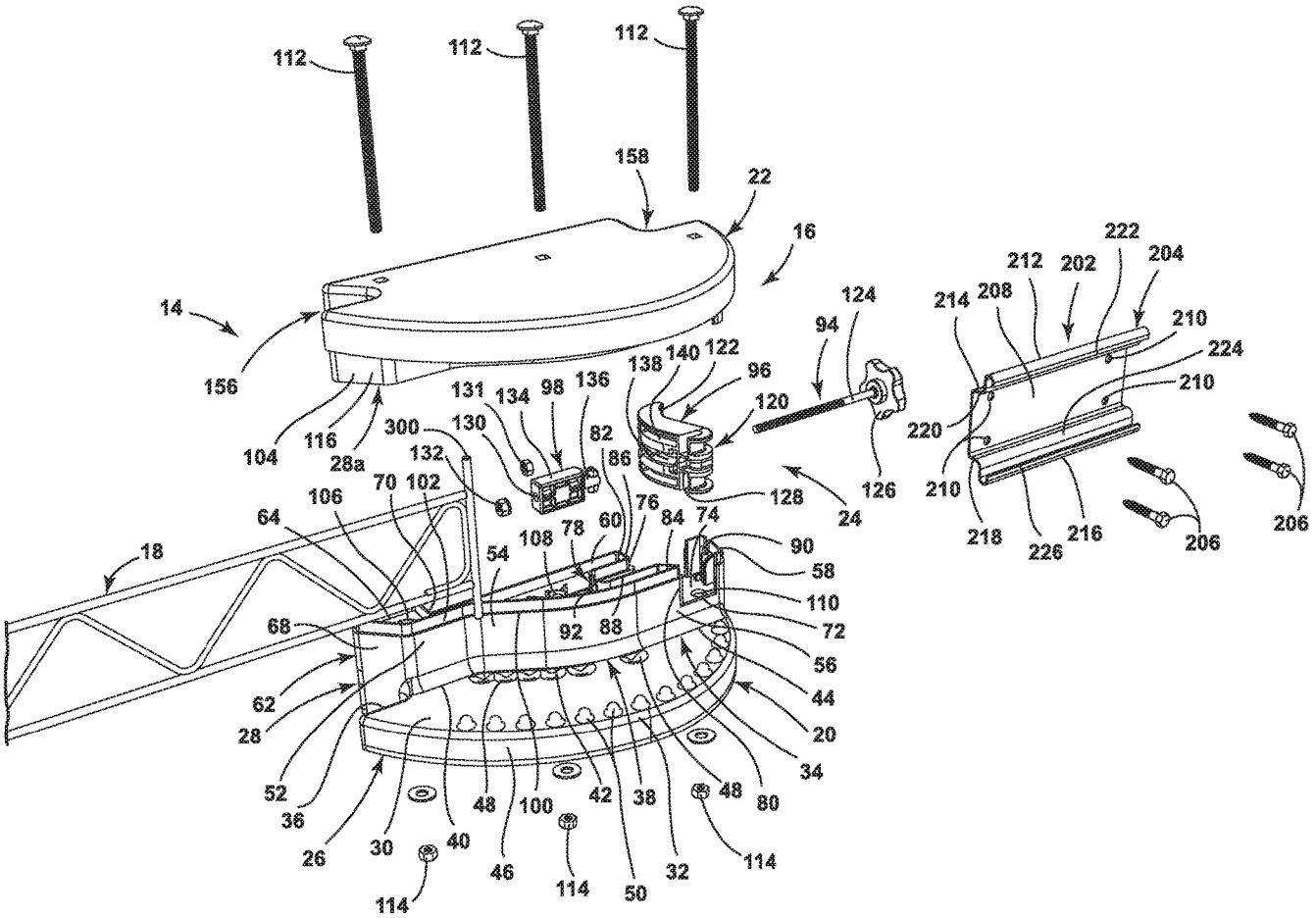
FIG. 3 is an exploded perspective view of the clothes dryer of the present invention.

For purposes of description herein, the terms "top," "bottom," "right," "left," "rear," "front," "vertical," "horizontal," and derivatives thereof shall relate to the invention as orientated in FIG. 3. However, it is to be understood that the invention may assume various alternative orientations (e.g., the elements described as being on the left can be on the right and vice-versa), except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
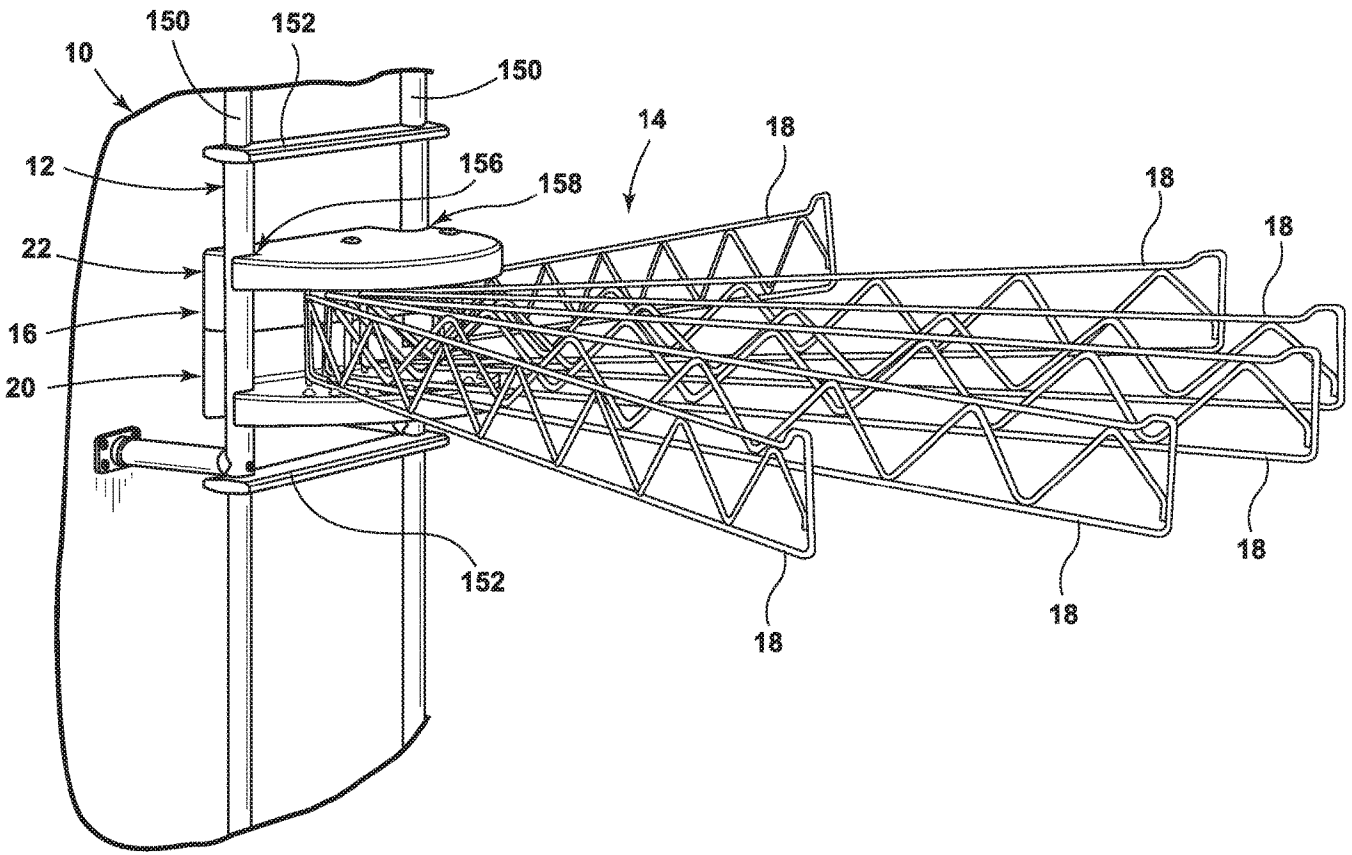
FIG. 1 is a perspective view of a clothes dryer of the present invention in a deployed position on a ladder of a vehicle.
Figure 2:
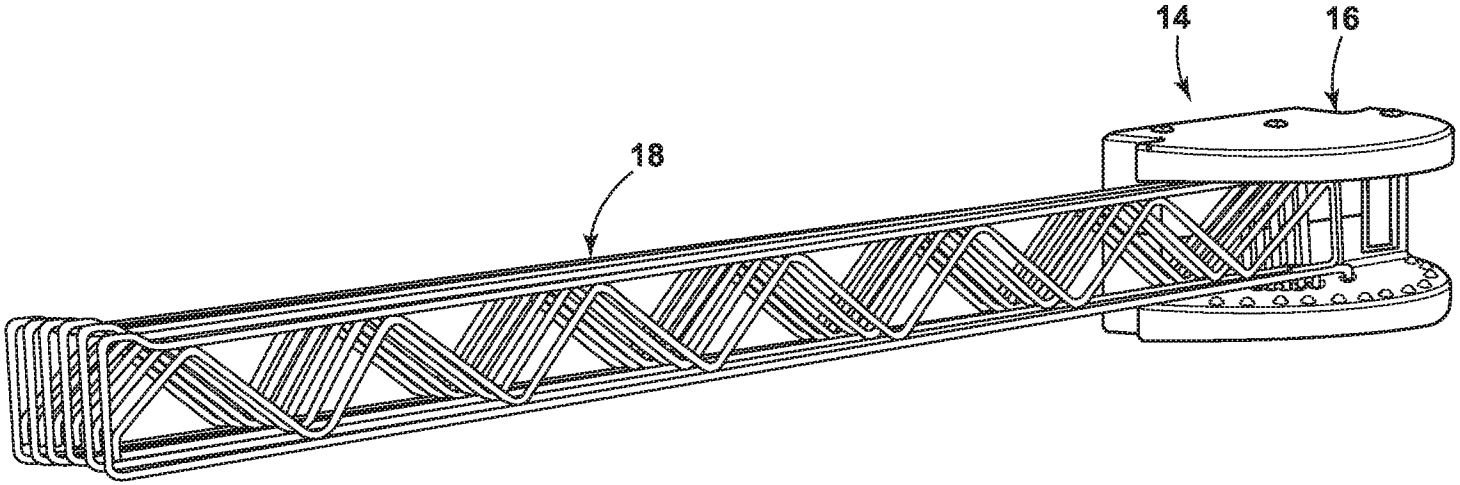
FIG. 2 is a perspective view of the clothes dryer of the present invention in a storage position.

FIG. 1 illustrates a recreational vehicle 10 having a ladder 12 thereon. An embodiment of a clothes dryer 14 is connected to the ladder 12. The clothes dryer 14 includes a dryer body 16 connected to the ladder 12 and a plurality of dryer arms 18 extending in a cantilever manner from the dryer body 16. The dryer arms 18 are configured to support clothes thereon for drying the clothes (e.g., shirts, pants, shoes, towels, swim suits, etc.) FIG. 1 illustrated the clothes dryer 14 in a deployed position wherein the dryer arms 18 are separated for easily placing clothes thereon. The dryer arms 18 can be rotated to place the clothes dryer 14 in a storage position as illustrated in FIG. 2 for storage. The clothes dryer 14 can also be removed from connection to the ladder 12 for storage during travel of the recreational vehicle 10.

The illustrated dryer body 16 (FIGS. 1-4) is configured to be removably connected to the ladder 12. The dryer body 16 includes a body bottom half 20, a body top half 22 and a rotating gripping arm assembly 24. The dryer arms 18 are secured between the body bottom half 20 and the body top half 22. The rotating gripping arm assembly 24 is employed to selectively grip a portion of the ladder 12 to removably connect the dryer body 16 to the ladder 12.

In the illustrated embodiment, the body bottom half 20 of the dryer body 16 is rigidly connected to the body top half 22 and supports the dryer arms 18 thereon. The body bottom half 20 includes a support platform 26 and a rear wall 28 connected to the support platform 26. The support platform 26 and the rear wall 28 can be an integral part (as illustrated) or can be formed of separate, but connected parts. Furthermore, the support platform 26 and the rear wall 28 can be made of any material (e.g., metal or plastic). The illustrated support platform 26 includes a support floor surface 30 having an arcuate front edge 32 and a rear edge 34. The rear edge 34 includes a left portion free edge area 36 and a wall connection portion 38 to the right of the left portion free edge area 36 as illustrated in FIG. 3. The wall connection portion 38 of the rear edge 34 includes a left side edge area 40 co-linear with the left portion free edge area 36, a central angled area 42 angled toward the arcuate front edge 32 and a right side edge area 44 that is substantially parallel to the left portion free edge area 36 and the left side edge area 40. A peripheral skirt 46 extends downward from the periphery of the support floor surface 30 for support. It is contemplated that the body bottom half 20 could include a plurality of crisscrossing supporting struts connected to an inside surface of the peripheral skirt 46 and a bottom surface of the support floor surface 30 for providing strength and rigidity to the support platform 26. As discussed in more detail below, the support floor surface 30 includes a plurality of openings 48 for accepting a portion of the dryer arms 18 therein and a plurality of tabs 50 adjacent the arcuate front edge 32 for maintaining a position of the dryer arms 18 in the deployed position.

The illustrated rear wall 28 of the body bottom half 20 connects to the body top half 22 to form the dryer body 16. The rear wall 28 of the body bottom half 20 is connected to the wall connection portion 38 of the rear edge 34 of the support floor surface 30. The rear wall 28 includes a left side area 52 extending upwardly perpendicularly from the left side edge area 40 of the rear edge 34, a central angled area 54 extending upwardly perpendicularly from the central angled area 42 of the rear edge 34, a right side area 56 extending upwardly perpendicularly from the right side edge area 44 of the rear edge 34, a right side end wall area 58 extending rearwardly from the right side edge area 44, a back wall area 60 extending laterally from a rear edge of the right side end wall area 58 and substantially parallel to the left side area 52 and the right side area 56, and a trapezoidal section 62 connected to the back wall area 60 and the left side area 52. The trapezoidal section 62 includes a long rear panel 64, an outside plate 68 connected to the long rear panel 64 and the left side area 52 and an inside plate 70 connected to the long rear panel 64 and the back wall area 60. The outside plate 68 and the inside plate 70 converge in a direction toward each other from a largest distance at the long rear panel 64 to a smallest distance at the left side area 52 and the back wall area 60, respectively.

In the illustrated example, the rear wall 28 accommodates a portion of the rotating gripping arm assembly 24 therein. The right side area 56 of the rear wall 28 includes a front U-shaped slot 72 opening at a top of the right side area 56. A bottom of the front U-shaped slot 72 defines a gripping arm assembly support surface 74. The back wall area 60 includes a rear U-shaped slot 76 opening at a top of the back wall area 60. The rear U-shaped slot 76 is substantially aligned with the front U-shaped slot 72, although the rear U-shaped slot 76 is slightly wider. The rear U-shaped slot 76 also has a bottom at the gripping arm assembly support surface 74. A connection wall portion 78 extends between an inside edge 80 of the front U-shaped slot 72 and an inside edge 82 of the rear U-shaped slot 76. The connection wall portion 78 includes a front angled panel 84 connected to the inside edge 80 of the front U-shaped slot 72 and extending rearwardly and inwardly therefrom, a rear wall panel 86 extending toward the right side area 56 of the rear wall 28, and a U-shaped panel 88 (as viewed from above) that extends between the front angled panel 84 and the rear wall panel 86. A top edge of the right side end wall area 58 includes a first slot 90 and a top edge of the curved portion of the U-shaped panel 88 includes a second slot 92 aligned with the first slot 90. As discussed in more detail below, the first slot 90 and the second slot 92 are configured to accept a pivot rod 94 of the rotating gripping arm assembly 24. Moreover, a pivot arm 96 of the rotating gripping arm assembly 24 rests on the gripping arm assembly support surface 74. Furthermore, a pull member 98 of the rotating gripping arm assembly 24 rests on the gripping arm assembly support surface 74 within the U-shaped panel 88 of the connection wall portion 78.

Figure 4:
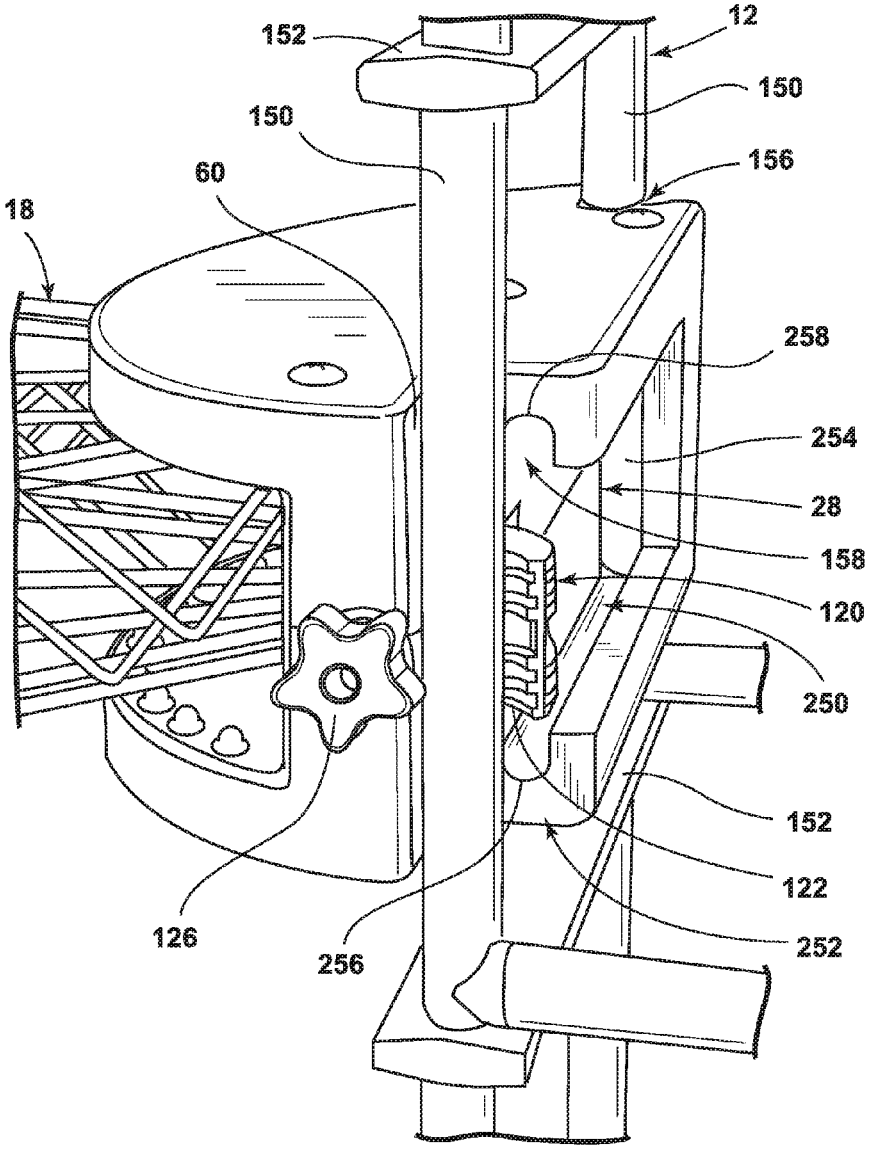
FIG. 4 is a rear side perspective view of the clothes dryer connected to the ladder of the vehicle.

The illustrated rear wall 28 connects the body bottom half 20 to the body top half 22. As illustrated in FIG. 4, the rear wall 28 includes a ledge 100 adjacent the top of each the left side area 52, the central angled area 54, the right side area 56, the right side end wall area 58, the back wall area 60, and the trapezoidal section 62. The ledge 100 defines a thinner upper rear wall top section 102. The body top half 22 includes a downwardly depending wall 104 that slides over the thinner upper rear wall top section 102 when the body top half 22 is connected to the body bottom half 20. The body bottom half 20 includes a first fastener tube 106 located within the trapezoidal section 62, a second fastener tube 108 connected by struts to the back wall area 60 and the central angled area 54 and a third fastener tube 110 in the gripping arm assembly support surface 74 adjacent the front U-shaped slot 72 in the right side area 56 of the rear wall 28. Fasteners 112 extend through the body top half 22 and through the first fastener tube 106, the second fastener tube 108 and the third fastener tube 110 to connected the body bottom half 20 to the body top half 22. Nuts 114 are screwed onto a bottom of the fasteners 112 to lock the fasteners 112 in position. The fastener 112 extending through the third fastener tube 110 also acts as a pivot for the pivot arm 96 of the rotating gripping arm assembly 24.

In the illustrated example, the body top half 22 and the body bottom half 20 capture the dryer arms 18 therebetween. The body top half 22 is substantially a mirror image of the body bottom half 20, except that the body top half 22 does not include any tabs 50 (although the body top half 22 could include tabs 50). Furthermore, the ledge of the rear wall **28*a* of the body top half 22 is on the inside instead of on the outside as in the body bottom half 20 as described above to allow the rear wall of the body top half 22 to be received within the body bottom half 20. Therefore, a bottom edge 116 of the rear wall 28*a* of the body top half 22 envelopes a top of the rear wall 28 of the body bottom half 20. Moreover, the body top half 22 does not include the first slot 90 in the right side end wall area or the second slot in the curved portion of the U-shaped panel as the pivot rod 94 of the rotating gripping arm assembly 24 fully rests within the body bottom half 20. Furthermore, the top surface of the body top half 22** is flat and support struts are located under the top flat surface.

The illustrated rotating gripping arm assembly 24 includes the pivot rod 94, the pivot arm 96 and the pull member 98. The pivot arm 96 is curved as viewed from above and includes a first end 120 receiving the fastener 112 extending through the third fastener tube 110. The pivot arm 96 pivots about the fastener 112 extending through the third fastener tube 110. A concave face 122 of the pivot arm 96 is used to grip the ladder 12 as discussed below. The pivot rod 94 includes a threaded post 124 and a grip 126 connected to an end of the threaded post 124. The threaded post 124 of the pivot rod 94 extends through the first slot 90 in the rear wall 28, through a lateral opening 128 in the pivot arm 96 adjacent the first end 120 but rear of the third fastener tube 110, through the pull member 98 of the rotating gripping arm assembly 24 into a first nut 131, through the second slot 92 in the rear wall 28, and into a second nut 132. The pull member 98 includes a block 134 and a T-shaped projection 136, with an opening 130 extending through the block 134 and the T-shaped projection 136. The pull member 98 is located in the U-shaped panel 88 of the connection wall portion 78. The T-shaped projection 136 is received in a recess 138 in a convex face 140 of the pivot arm 96. The threaded post 124 of the pivot rod 94 extends through the opening 130 in the pull member 98. As the grip 126 of the pivot rod 94 is rotated, the threaded post 124 also rotates. Rotation of the threaded post 124 moves the pivot rod 124 into and out of the second nut 132 (which is prevented from rotating), thereby moving the grip 126 toward and away from the second nut 132 (as the threaded post 124 is "screwed" and "unscrewed"). The threaded post 124 of the pivot rod 94 extends through the opening 130 in the pull member 98. The first nut 131 rotates with the threaded post 124 of the pivot rod 94 and thereby pulls on the pull member 98 when the grip 126 moves away from the second nut 132. As the grip 126 moves away from the second nut 132, the T-shaped projection 136 of the pull member 98 forces the pivot arm 96 to pivot.

In the illustrated example, the rotating gripping arm assembly 24 secures the clothes dryer 14 to the ladder 12. The ladder 12 includes a pair of parallel vertical support beams 150 having a plurality of steps 152 extending therebetween. As illustrated in FIGS. 1 and 4, a left one of the vertical support beams 150 is received within a first capture area 156 and a right one of the vertical support beams 150 is received within a second capture area 158 of the dryer body 16. The first capture area 156 is located between the left portion free edge area 36 of the rear edge 34 of the body bottom half 20 and the body top half 22 and the outside plate 68 of the trapezoidal section 62 of the rear wall 28 of the body bottom half 20 and the rear wall **28*a* of the body top half 22. The second capture area 158 is located between the back wall area 60 of the rear wall 28 to the right of the rear U-shaped slot 76 and the concave face 122 of the pivot arm 96. When the pivot rod 94 is fully screwed into the second nut 132, the right one of the vertical support beams 150 can enter into the second capture area 158. As the pivot rod 94 is rotated to move the grip 126 away from the second nut 132, the pull member 98 forces the pivot arm 96 to pivot, thereby forcing the concave face 122 of the pivot arm 96 against the right one of the vertical support beams 150 and rigidly connecting the clothes dryer 14 to the ladder 12**.

Figure 5:
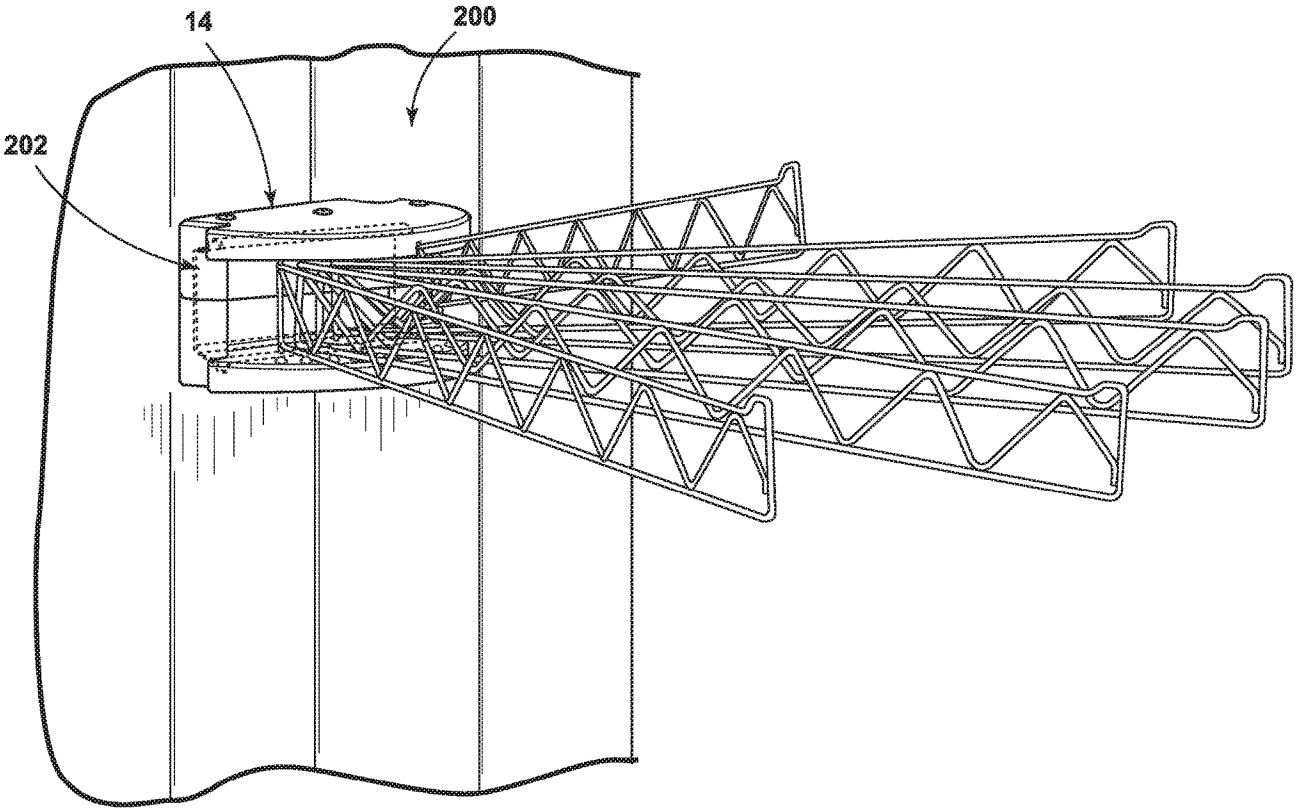
FIG. 5 is a perspective view of the clothes dryer of the present invention in a deployed position on a vertical support surface.

The illustrated clothes dryer 14 can also be connected to a vertical surface 200 using a wall mount assembly 202 (see FIGS. 3-5). The wall mount assembly 202 includes a wall mount bracket 204 that is configured to be connected to the vertical surface 200 using fasteners 206. The wall mount bracket 204 includes a rear plate 208 having a plurality of holes 210 for accepting the fasteners 206 therethrough, with the fasteners 206 being inserted into the vertical surface 200 (e.g., by screwing). A top projection 212 extends from a top edge 214 of the rear plate 208 and a bottom projection 216 extends from a bottom edge 218 of the rear plate 208. The top projection 212 has a forwardly extending panel 220 and an inverted J-shaped panel 222 extending upwardly therefrom. The bottom projection 216 has a forwardly extending panel 224 and a J-shaped panel 226 extending downwardly therefrom. As illustrated in FIG. 4, the rear wall 28*a* of the body top half 22 and the rear wall 28 of the body bottom half 20 define a recess 250 that has an open first side 252 at the second capture area 158 and a closed second side 254 at the inside plate 70 of the trapezoidal section 62 of the rear wall 28 and the rear wall 28*a*. A bottom of the recess 250 includes a bottom groove 256 and a top of the recess 250 includes a top groove 258.

In the illustrated example, the wall mount assembly 202 is connected to the vertical surface 200. The clothes dryer 14 can then be connected to the wall mount assembly 202 by sliding the wall mount bracket 204 into the recess 250 in the dryer body 16 from the open first side 252 of the recess 250. As the wall mount bracket 204 is slid into the recess 250, the inverted J-shaped panel 222 of the top projection 212 of the wall mount bracket 204 slides into the top groove 258 of the recess 250 and the J-shaped panel 226 of the bottom projection 216 slides into the bottom groove 256 of the recess 250. The wall mount assembly 202 allows the clothes dryer 14 to be stored (e.g., for travel) and brought out and easily connected to the vertical surface 200 for use. Once the wall mount assembly 200 is connected to the vertical surface 200, no tools are required to connect and disconnect the clothes dryer 14 thereto.

The illustrated dryer arms 18 are configured to be moved between a storage position as shown in FIG. 2 and a deployed position as shown in FIG. 1. The dryer arms 18 have a first end with a pivot pin 300 (or a pair of aligned pivot pins) that extends downward and upward into the openings 48 in the support floor surface 30 of the support platform 26 of the body bottom half 20 and the body top half 22, respectively. The pivot pin 300 allows each dryer arm 18 to be moved from the storage position to the deployed position and back again. The dryer arms 18 can have any configuration. Although the dryer arms 18 are illustrated as being a plurality of wires that can have clothes hung over top thereof or have hangers hung thereon, the dryer arms 18 can have any design (e.g., wires as shown or a single solid body). As outlined above, the openings 48 are located at a first end of the central angled area 42, a second end of the central angled area 42 and between the first end and the second end of the central angled area 42. The front to back spacing of the openings 48 are about equal to a width of the dryer arms 18, Moreover, the openings 48 between the opening 48 at the first end and the opening 48 at the second end of the central angled area 42 are in a line. Therefore, when the dryer arms 18 are in the storage position, the dryer arms 18 are flat against each other as illustrated in FIG. 2. Each arm 18 in the deployed position is located between a pair of the tabs 50 to maintain the arms 18 in the deployed position. It is contemplated that the arms 18 can be lifted over the tabs 50 (e.g., by having a height of the arms 18 other than the pivot pin 300 be smaller than the distance between the support floor surfaces 30 of the body bottom half 20 and the body top half 22) or that the tabs 50 can be flexible (e.g, made out of deformable material) to deform to allow arms 18 to pass thereby. It is further contemplated that, instead of the tabs 50, the support floor surface 30 of the body bottom half 20 could include channels ending at the openings 48 such that a bottom of each arm 18 can rest in the openings 48 to maintain the arms 18 in the deployed position. It is further contemplated that each opening 48 could have one or more channels ending thereat.

Although particular preferred embodiments of the invention have been disclosed in detail for illustrative purposes, it will be recognized that variations or modifications of the disclosed apparatus, including the rearrangement of parts, lie within the scope of the present invention. For example, the clothes dryer 14 can be connected to any surface using the wall mount assembly 202 (in an RV or anywhere else).

The above description is considered that of the one embodiment only. Modification of the invention will occur to those skilled in the art and to those who make or use the invention. Therefore, it is understood that the embodiment shown in the drawings and described above is merely for illustrative purposes and not intended to limit the scope of the invention.

What is claimed is:

1. A clothes dryer comprising:

a dryer body configured to be connected to a support; and a plurality of dryer arms pivotally connected to the dryer body, the dryer arms being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions;

the dryer body including a substantially planar bottom wall having a plurality of tabs extending upwardly from the substantially planar bottom wall, each pair of adjacent tabs defining one of the channels;

the dryer body further including a top wall and a rear wall, the top wall and the bottom wall including a plurality of aligned openings, each of the aligned openings defining one of the pivot points of the dryer arms; and the dryer body being formed from at least a top portion and a separate bottom portion, the top portion including the top wall and the bottom portion including the bottom wall.

2. The clothes dryer according to claim 1, wherein:

each of the dryer arms includes a pivot pin extending into one of the aligned openings.

3. A clothes dryer comprising:

a dryer body configured to be connected to a support;

a plurality of dryer arms pivotally connected to the dryer body, the dryer arms being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions;

the dryer body including a substantially planar bottom wall having a plurality of tabs extending upwardly from the substantially planar bottom wall, each pair of adjacent tabs defining one of the channels;

the dryer body further including a top wall and a rear wall, the top wall and the bottom wall including a plurality of aligned openings, each of the aligned openings defining one of the pivot points of the dryer arms;

the dryer arms each having a generally planar profile with the pivot points thereof being parallel to the planar profile;

at least three of the pivot points being positioned along a line; and the planar profile of the dryer arms at the at least three of the pivot points positioned along the line being parallel when in the stored position and not being parallel when in the deployed position.

4. A clothes dryer comprising:

a dryer body configured to be connected to a support; and a plurality of dryer arms pivotally connected to the dryer body, the dryer arms being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions; and a pair of parallel vertical posts;

wherein the dryer body includes a vertical slot for receiving a first one of the parallel vertical posts, a capture area for receiving a second one of the parallel vertical posts, and a selectively movable grip configured to press the second one of the parallel vertical posts into the capture area to fixedly connect the dryer body to the pair of parallel vertical posts.

5. A clothes dryer comprising:

a dryer body configured to be connected to a support;

a plurality of dryer arms pivotally connected to the dryer body, the dryer arms being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions; and a bracket having a connection face, a top L-shaped flange and a bottom L-shaped flange;

wherein the dryer body includes a horizontal slot including a top groove and a bottom groove, the top L-shaped flange of the bracket being slidably received in the top groove and the bottom L-shaped flange of the bracket being slidably received in the bottom groove to connect the dryer body to the bracket.

6. A clothes dryer comprising:

a dryer body configured to be connected to a support; and at least three dryer arms pivotally connected to the dryer body, the dryer arms each being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

each of the dryer arms having a generally planar profile with the pivot point thereof being parallel to the planar profile;

at least three of the pivot points being positioned along a line;

the planar profile of the dryer arms at the at least three of the pivot points positioned along the line being parallel when in the stored position and not being parallel when in the deployed position; and the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions.

7. The clothes dryer according to claim 6, wherein:

the dryer body includes a substantially planar bottom wall having a plurality of tabs extending upwardly from the substantially planar bottom wall, each pair of adjacent tabs defining one of the channels.

8. The clothes dryer according to claim 7, wherein:

the dryer body further includes a top wall and a rear wall, the top wall and the bottom wall including a plurality of aligned openings, each of the aligned openings defining one of the pivot points of the dryer arms.

9. The clothes dryer according to claim 8, wherein:

each of the dryer arms includes a pivot pin extending into one of the aligned openings.

10. The clothes dryer according to claim 8, wherein:

the dryer arms each have a generally planar profile with the pivot points thereof being parallel to the planar profile;

at least three of the pivot points are positioned along a line; and the planar profile of the dryer arms at the at least three of the pivot points positioned along the line are parallel when in the stored position and are not parallel when in the deployed position.

11. A clothes dryer comprising:

a dryer body configured to be connected to a support;

at least three dryer arms pivotally connected to the dryer body, the dryer arms each being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

each of the dryer arms having a generally planar profile with the pivot point thereof being parallel to the planar profile;

at least three of the pivot points being positioned along a line; and the planar profile of the dryer arms at the at least three of the pivot points positioned along the line being parallel when in the stored position and not being parallel when in the deployed position; and a pair of parallel vertical posts;

wherein the dryer body includes a vertical slot for receiving a first one of the parallel vertical posts, a capture area for receiving a second one of the parallel vertical posts, and a selectively movable grip configured to press the second one of the parallel vertical posts into the capture area to fixedly connect the dryer body to the pair of parallel vertical posts.

12. A clothes dryer comprising:

a dryer body configured to be connected to a support;

at least three dryer arms pivotally connected to the dryer body, the dryer arms each being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

each of the dryer arms having a generally planar profile with the pivot point thereof being parallel to the planar profile;

at least three of the pivot points being positioned along a line; and the planar profile of the dryer arms at the at least three of the pivot points positioned along the line being parallel when in the stored position and not being parallel when in the deployed position; and a bracket having a connection face, a top L-shaped flange and a bottom L-shaped flange;

wherein the dryer body includes a horizontal slot including a top groove and a bottom groove, the top L-shaped flange of the bracket being slidably received in the top groove and the bottom L-shaped flange of the bracket being slidably received in the bottom groove to connect the dryer body to the bracket.

13. A clothes dryer comprising:

a dryer body configured to be connected to a support; and at least three dryer arms pivotally connected to the dryer body, the dryer arms each being pivotally connected to the dryer body about pivot points, the dryer arms being able to be folded into a stored position wherein at least two of the dryer arms abut each other and a deployed position wherein at least two of the dryer arms are spread out to allow clothes to be placed thereon or connected thereto for drying;

the dryer body including having a vertical slot for receiving a vertical post of the support for connecting the dryer body to the support; and the dryer body also including a horizontal slot for receiving a bracket for connecting the dryer body to the support.

14. The clothes dryer according to claim 13, wherein:

the dryer body including a plurality of channels, each of the channels being able to selectively receive one of the dryer arms therein to fix the one of the dryer arms in the deployed position, each of the dryer arms being able to be received in at least two of the channels such that each of the dryer arms can be positioned in a plurality of fixed positions; and the dryer body includes a substantially planar bottom wall having a plurality of tabs extending upwardly from the substantially planar bottom wall, each pair of adjacent tabs defining one of the channels.

15. The clothes dryer according to claim 13, further including:

a pair of parallel vertical posts;

wherein the vertical slot receives a first one of the parallel vertical posts, the dryer body includes a capture area for receiving a second one of the parallel vertical posts and a selectively movable grip configured to press the second one of the parallel vertical posts into the capture area to fixedly connect the dryer body to the pair of parallel vertical posts.

16. The clothes dryer according to claim 13, further including:

a bracket having a connection face, a top L-shaped flange and a bottom L-shaped flange;

wherein the horizontal slot includes a top groove and a bottom groove, the top L-shaped flange of the bracket being slidably received in the top groove and the bottom L-shaped flange of the bracket being slidably received in the bottom groove to connect the dryer body to the bracket.

* * * * *